US008033922B1

(12) United States Patent
Marquez

(10) Patent No.: US 8,033,922 B1
(45) Date of Patent: Oct. 11, 2011

(54) MANUALLY PUSHED SWING

(76) Inventor: Linda Marquez, Desert Hot Springs, CO (US)

( * ) Notice: Subject to any disclaimer, the term of this patent is extended or adjusted under 35 U.S.C. 154(b) by 134 days.

(21) Appl. No.: 12/571,897

(22) Filed: Oct. 1, 2009

(51) Int. Cl.
*A63G 9/12* (2006.01)
*A63G 9/00* (2006.01)

(52) U.S. Cl. ..... 472/118; 472/33; 472/121

(58) Field of Classification Search ..... 472/1, 16, 472/19, 32, 33, 20, 14, 118, 121; 482/33, 482/66, 69
See application file for complete search history.

(56) References Cited

U.S. PATENT DOCUMENTS

| | | | | | |
|---|---|---|---|---|---|
| 386,358 | A | * | 7/1888 | Simpson | 472/33 |
| 551,782 | A | * | 12/1895 | Muller | 472/20 |
| 1,142,970 | A | | 6/1915 | Koehler | |
| 1,447,110 | A | | 2/1923 | Weaser | |
| 1,658,302 | A | * | 2/1928 | Renaud | 280/7.12 |
| 2,765,168 | A | | 10/1956 | Taylor | |
| 2,777,691 | A | | 1/1957 | Malone | |
| 2,925,272 | A | | 2/1960 | Harness | |
| 3,397,881 | A | * | 8/1968 | Hedgecock | 472/14 |
| 3,595,570 | A | | 7/1971 | Huff et al. | |
| 3,599,973 | A | * | 8/1971 | Ahrens | 472/4 |
| 5,709,606 | A | | 1/1998 | Ehrman | |

* cited by examiner

*Primary Examiner* — Kien Nguyen

(57) ABSTRACT

The manually pushed swing involves a vertical pole that is anchored into the ground via a concrete base, wherein a swing top mounts atop said pole and enables a plurality of swings seats and push handles to be connected thereon. The push handles enable a non-occupant to propel the plurality of swing seats around the pole via a bearing. The manually pushed swing is ideally suited for outdoor use.

6 Claims, 4 Drawing Sheets

MANUALLY PUSHED SWING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of The Invention

The present invention relates to the field of swings, more specifically, a children's swing that supports a plurality of seats and of which is manually operated.

B. Discussion of the Prior Art

As a preliminary note, it should be stated that there is an ample amount of prior art that deals with swings. As will be discussed immediately below, no prior art discloses a circular swing set that supports a plurality of seats and of which is manually operated via a plurality of push handles each of which extends from the center.

The Koehler patent (U.S. Pat. No. 1,142,970) discloses a circular swing set with a mechanized means of propelling the swing seats around the center. However, the swing set does not rely upon push handles for propelling the swing seats about the said seats.

The Ehrman patent (U.S. Pat. No. 5,709,606) discloses a rotatable swing set for providing amusement to children by spinning children secured within swings seats around a central point. However, the swing set is not manually operated via a plurality of push handles that extend from the center above where the swings attach.

The Malone patent (U.S. Pat. No. 2,777,691) discloses a child's merry-go-round. However, an occupant propels the swing as opposed to another person that is a non-occupant, and wherein said non-occupant propels the swing via push handles extending from the center and extending above the swings.

The Hannas patent (U.S. Pat. No. 2,925,272) discloses a merry-go-round swing. However, the swing is propelled via a pulley system as opposed to a plurality of push handles that extend from the center atop where the seats hang, and of which the swing is propelled by a non-occupant.

The Huff patent (U.S. Pat. No. 3,595,570) discloses an occupant-propelled roundabout swing set. Again, one of the occupants propels the swing as opposed to a non-occupant who pushes upon one of a plurality of push handles that extend from a center.

The Taylor patent (U.S. Pat. No. 2,765,168) discloses a children's carousel. However, the carousel is powered by a motor and mechanical means as opposed to a manually propelled swing that is powered by a non-occupant pushing on one of a plurality of push handles that extend from a center.

The Weaser patent (U.S. Pat. No. 1,447,110) discloses a children's merry-go-round. However, the merry-go-round is occupant propelled via a spring-loaded linkage set as opposed to a non-occupant propelled swing that only includes push handles.

While the above-described devices fulfill their respective and particular objects and requirements, they do not describe a swing set that is propelled by push handles acted upon by a non-occupant, and wherein said push handles extend from the center atop where the swing seats connect. In this regard, the manually pushed swing departs from the conventional concepts and designs of the prior art.

BRIEF SUMMARY OF THE INVENTION

The manually pushed swing involves a vertical pole that is anchored into the ground via a concrete base, wherein a swing top mounts atop said pole and enables a plurality of swings seats and push handles to be connected thereon. The push handles enable a non-occupant to propel the plurality of swing seats around the pole via a bearing. The manually pushed swing is ideally suited for outdoor use.

An object of the invention is to provide a swing set involving a plurality of seats, and of which is propelled by a non-occupant acting upon one of a plurality of push handles.

These together with additional objects, features and advantages of the manually pushed swing will be readily apparent to those of ordinary skill in the art upon reading the following detailed description of presently preferred, but nonetheless illustrative, embodiments of the manually pushed swing when taken in conjunction with the accompanying drawings.

In this respect, before explaining the current embodiments of the manually pushed swing in detail, it is to be understood that the manually pushed swing is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the manually pushed swing. It is therefore important that the claims be regarded as including such equivalent construction insofar as they do not depart from the spirit and scope of the manually pushed swing.

It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
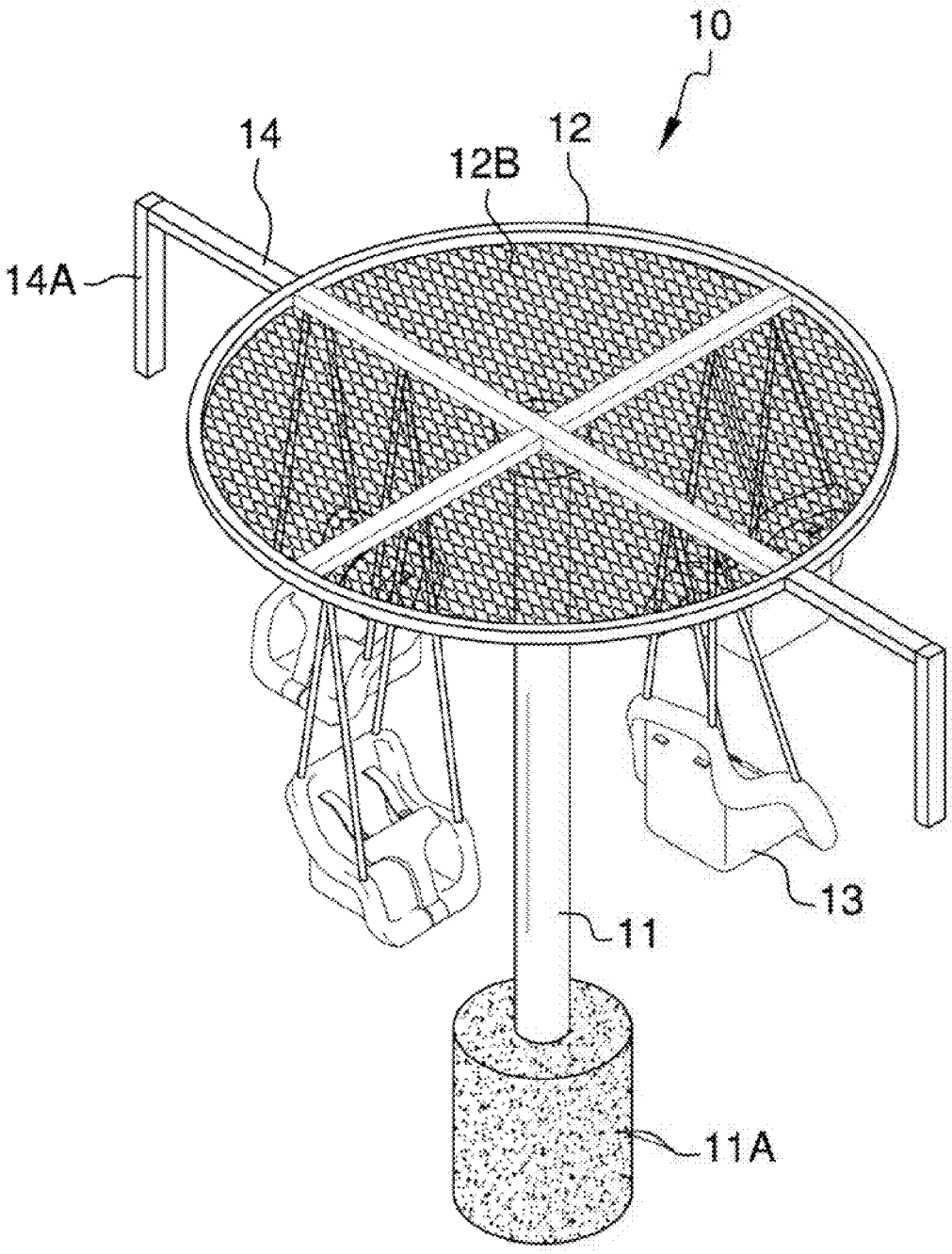
FIG. 1 illustrates an isometric view of the manually pushed swing by itself.
Figure 2:
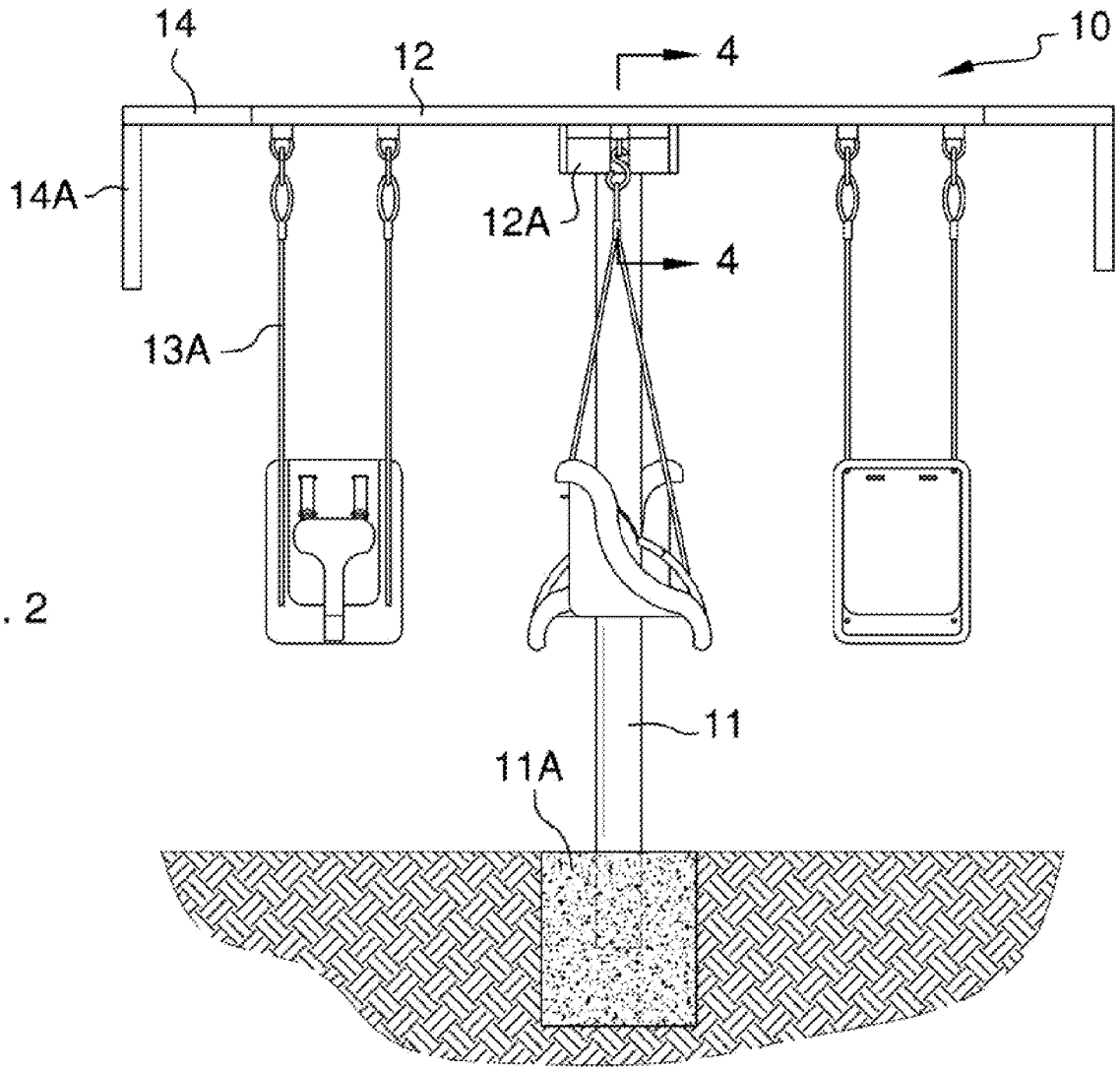
FIG. 2 illustrates a front view of the manually pushed swing anchored to the ground with detail indicating the concrete base completely submerged within the ground.
Figure 3:
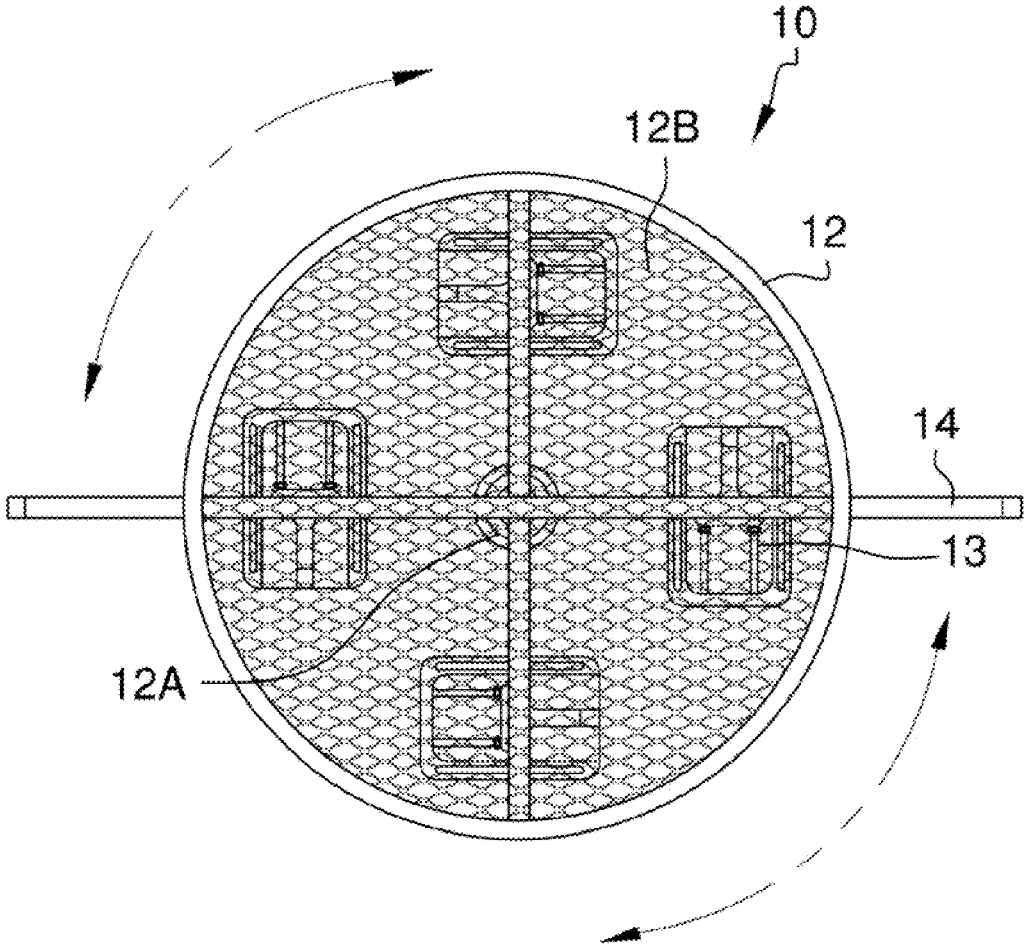
FIG. 3 illustrates a top view of the manually pushed swing with arrows indicating rotational movement of the swing top, push handles, and swing seats in either clockwise or counterclockwise direction.
Figure 4:
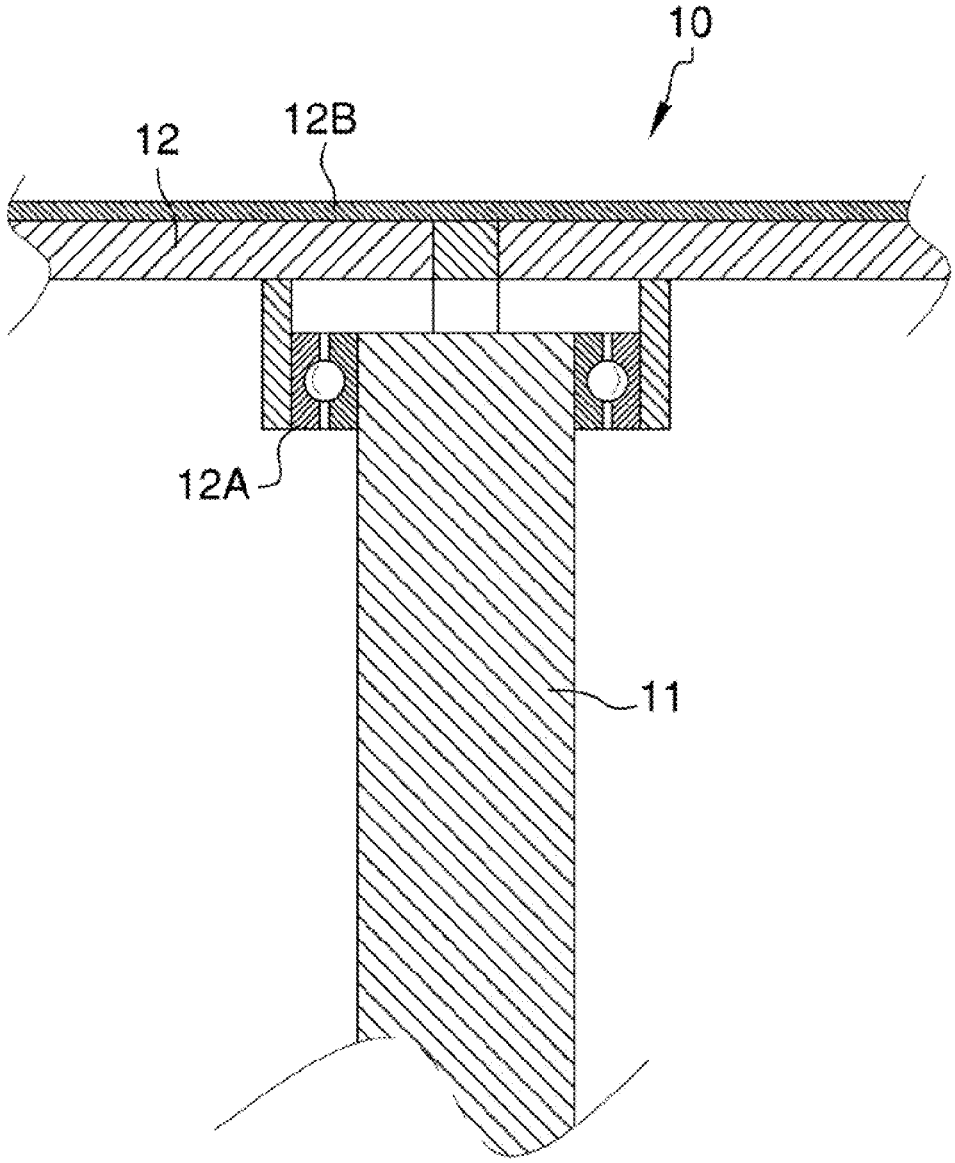
FIG. 4 illustrates a cross-sectional view of the manually pushed swing along line 4-4 in FIG. 2, and detailing the ball bearing connection between the pole and swing top.

Detailed reference will now be made to the preferred embodiment of the present invention, examples of which are illustrated in FIGS. 1-4. A manually pushed swing 10 (hereinafter invention) is comprised of a pole 11, swing top 12, a plurality of swing seats 13, and a plurality of push handles 14.

The pole 11 is anchored to the ground in a vertical position, and may include a concrete base 11A to bolster the overall stability of the invention 10. The concrete base 11A should be at least completely submerged into the surrounding ground, and may extend an additional length from a bottom end of said pole 11.

The pole 11 can generally extend from the ground to a height of no less than 5 feet, and not higher than 10 feet. The pole 11 can be made of a stock or shape involving a round or square stock. It shall also be noted that the selection of size and material shall be considerate to the loads placed upon the invention 10.

The swing top 12 is affixed atop said pole 11 via a ball bearing 12A. The ball bearing 12A enables rotational movement of the swing top 12 about said pole 11, and wherein said rotational movement can be either clockwise or counterclockwise.

The swing top 12 is further defined by including a circular construction, and a protective mesh 12B that shelters the swing seats 13 from falling debris as well as to minimize or eliminate the exposure to sunlight. The swing seats 13 hang down from the swing top 12 via swing lines 13A. The swing seats 13 are depicted as including safety straps to ensure that the occupant is secured to the swing seat 13 during use of the invention 10.

The push handles 14 attach atop the swing top 12, and extend from a central point that is coaxially aligned with the pole 11 and ball bearing 12A. The push handles 14 extend from beyond the swing top 12, and include a vertical member 14A that extend down in order to enable greater access of the push handle by a non-occupant. The invention 10 is used when a non-occupant pushes upon one of the push handles 14, thereby rotating both the swing top 12 and swing seats 13 about the pole 11.

The pole 11, swing top 12, push handles 14 are made of a material comprising a wood, plastic, metal, or carbon fiber.

Variations and alternatives of the present embodiment including equivalent structures and structural equivalents are readily apparent to those of ordinary skill in the art upon reading the present disclosure, and such variations and alternatives are incorporated in the invention unless otherwise expressly indicated in the claims.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

The inventor claims:

1. A manually pushed swing comprising:

a pole in vertical orientation that is anchored to the ground upon which a swing top is affixed with and can rotate thereupon in a horizontal plane in either clockwise or counterclockwise directions;

wherein a concrete base is affixed about a bottom of said pole to provide further stability when said pole is anchored to the ground;

wherein a ball bearing is attached atop said pole as well as the swing top, and thus enables rotational movement of the swing top about said pole;

a plurality of swing seats hang from said swing top;

wherein each swing seat includes a safety strap to ensure security of an occupant therein;

wherein the swing top is generally circular and includes a protective mesh to cover the swing seats from falling debris;

a plurality of push handles extend horizontally from said swing top, and enable a non-occupant to propel said swing top and swing seats about said pole;

use of the manually pushed swing occurs when said non-occupant pushes upon one of the push handles, thereby rotating both the swing top and swing seats about the pole.

2. The manually pushed swing as described in claim 1 wherein said push handles extend from a center of said swing top, and further include a vertical member that extends down from an outer edge of said push handle.

3. The manually pushed swing as described in claim 1 wherein the pole and the swing top are made of a material comprising a metal, wood, plastic, or carbon fiber.

4. A manually pushed swing comprising:

a pole in vertical orientation that is anchored to the ground upon which a swing top is affixed with and can rotate thereupon in a horizontal plane in either clockwise or counterclockwise directions;

a plurality of swing seats hang from said swing top via swing lines;

wherein each swing seat includes a safety strap to ensure security of an occupant therein;

a plurality of push handles extend horizontally from said swing top, and enable a non-occupant to propel said swing top and swing seats about said pole;

wherein said push handles extend from a center of said swing top, and further include a vertical member that extends down from an outer edge of said push handle;

wherein the swing top is generally circular and includes a protective mesh to cover the swing seats from falling debris;

a ball bearing being attached atop said pole as well as the swing top, and thus enables rotational movement of the swing top about said pole;

wherein the push handles extend from a central point that is coaxially aligned with the pole and ball bearing.

5. The manually pushed swing as described in claim 4 wherein a concrete base is affixed about a bottom of said pole to provide further stability when said pole is anchored to the ground.

6. The manually pushed swing as described in claim 4 wherein the pole and the swing top are made of a material comprising a metal, wood, plastic, or carbon fiber.

* * * * *